United States Patent [19]

Sugimoto et al.

[11] Patent Number: 4,506,008

[45] Date of Patent: Mar. 19, 1985

[54] SILVER HALIDE PHOTOGRAPHIC LIGHT-SENSITIVE MATERIALS

[75] Inventors: Tadao Sugimoto; Hideo Ikeda, both of Kanagawa, Japan

[73] Assignee: Fuji Photo Film Co., Ltd., Kanagawa, Japan

[21] Appl. No.: 502,808

[22] Filed: Jun. 9, 1983

[30] Foreign Application Priority Data

Jun. 9, 1982 [JP] Japan ..... 57-98927

[51] Int. Cl.[3] ..... G03C 1/76

[52] U.S. Cl. ..... 430/502; 430/509

[58] Field of Search ..... 430/509, 502

[56] References Cited

U.S. PATENT DOCUMENTS

| | | | |
|---|---|---|---|
| 2,996,382 | 8/1961 | Luckey et al. | 430/502 |
| 3,178,282 | 4/1965 | Luckey et al. | 430/596 |
| 3,708,300 | 1/1973 | Luckey | 430/564 |

*Primary Examiner*—Won H. Louie

*Attorney, Agent, or Firm*—Sughrue, Mion, Zinn, Macpeak and Seas

[57] ABSTRACT

A silver halide photographic light-sensitive material is disclosed. The material is comprised of a support base having positioned thereon a silver halide emulsion layer and a protective layer. The silver halide emulsion layer includes at least two component layers including an upper layer and a lower layer. The upper layer is comprised of a photosensitive silver halide emulsion and the lower layer is comprised of a photosensitive silver halide emulsion and an inside fogged silver halide emulsion. The particle size of the inside fogged silver halide emulsion is smaller than that of the photosensitive silver halide emulsion in the upper layer and the lower layer. The material is highly sensitive and forms images which have high contrast and high density. The material is capable of forming images having a pure black tone. When the materials are processed they create substantially no stain even if a stopping bath is not utilized.

7 Claims, 2 Drawing Figures

SILVER HALIDE PHOTOGRAPHIC LIGHT-SENSITIVE MATERIALS

FIELD OF THE INVENTION

The present invention relates to novel silver halide photographic light-sensitive materials and, in greater detail, to highly sensitive silver halide photographic light-sensitive materials for obtaining images having high contrast and high maximum density.

BACKGROUND OF THE INVENTION

With respect to photographic images composed of silver, the ratio of optical density of the images to silver content in a unit area of the images is generally called the covering power. The covering power is a measure for evaluating optical efficiency of silver composing the images. The covering power of the silver halide photographic light-sensitive layer generally increases with a decrease of the particle size of silver halide particles and reduces with an increase of the particle size thereof. On the other hand, the sensitivity of the silver halide emulsion layer generally becomes high with an increase of the particle size of silver halide particles. Thus, silver halide emulsions having a larger particle size are used to produce photographic light-sensitive materials having high sensitivity. Accordingly, the photographic light-sensitive materials having high sensitivity require a large silver content per unit area for obtaining a definit image density. Namely, in order to obtain both high sensitivity and the required maximum image density, it is necessary that the photographic light-sensitive material contains a larger amount of silver salts per unit area. This is an undesirable feature of the conventional photographic light-sensitive materials having high sensitivity.

The particle size of silver halide in the present invention means the diameter of particles when the particles are spherical or nearly spherical, or means the diameter of a sphere having the same volume when the particles have other shapes (for example, cube or plate, etc.).

Attempts at improving the covering power while maintaining high sensitivity which comprise adding various kinds of polymer to silver halide emulsions having highly sensitive coarse particles have been described in British Patent Nos. 1,048,057 and 1,039,471 and U.S. Pat. Nos. 3,043,697 and 3,446,618. However, these techniques are not suitable because the effect for improving the covering power is insufficient and strength of the coating film is reduced. Particularly, when a light-sensitive material having a coating film of poor strength is used in an automatic developing apparatus which are now conventionally used, some of the gelatin in the film dissolves in the developing solution or the fixing solution, adheres to conveying rolls of the automatic developing apparatus, and transfers to the light-sensitive material. This causes pollution of the photographic images.

On the other hand, it has been described in U.S. Pat. Nos. 2,996,382 and 3,178,282 that photographic images having high contrast and high covering power are obtained in a high sensitivity by using silver halide photographic light-sensitive materials wherein coarse particles of surface latent image type silver halide and fine silver halide particles having fog nuclei in the inner part thereof are contained in the same layer or adjacent layers. According to this process, it is supposed that coarse particles of surface latent image type silver halide are first developed and products resulting from the development attack neighboring fine silver halide particles having fog nuclei in the inner part thereof to cause development of the fine silver halide particles.

However, in this process, since the coarse particles having high sensitivity and the inside fogged fine particles are used, developed silver easily forms a large mottle which causes deterioration of granularity. Further, the color of the resulting images becomes brownish. Moreover, irregular stains are formed on the photographic material when it is allowed to pass directly through the fixing bath from the development bath by means of an automatic developing apparatus without passing through the stopping bath.

SUMMARY OF THE INVENTION

Accordingly, an object of the present invention is to provide highly sensitive silver halide photographic light-sensitive materials which form images having high contrast and high maximum density.

Another object of the present invention is to provide silver halide photographic light-sensitive materials having improved granularity which form images having a pure black tone.

A further object of the present invention is to provide silver halide photographic light-sensitive materials which create substantially no stain even if the stopping bath is not used.

As a result of earnest studies, the present inventors have found that the above-described objects can be attained by the following photographic light-sensitive materials. Namely, they can be attained by silver halide photographic light-sensitive materials comprising a silver halide emulsion layer and a protective layer provided on a base in turn. The silver halide emulsion layer is composed of at least two layers consisting of an upper layer and a lower layer. The upper layer contains a photosensitive silver halide emulsion, and the lower layer contains a photosensitive silver halide emulsion and an inside fogged silver halide emulsion. The particle size of the inside fogged silver halide in the lower layer is smaller than that of the photosensitive silver halide in the upper layer and that of the photosensitive silver halide in the lower layer.

DETAILED DESCRIPTION OF THE INVENTION

Figure 1:
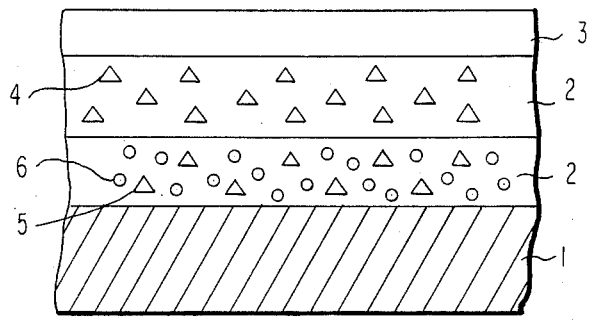
FIG. 1 is a sectional view of a preferred embodiment of the silver halide photographic light-sensitive material of the present invention, which comprises a base 1, an emulsion layer 2 composed of two layers and a protective layer 3, wherein the emulsion layer contains surface latent image type silver halide emulsions 4 and 5 containing silver iodide and an internal latent image type silver halide emulsion 6.

The term "photosensitive" used in the present invention means that the sensitivity of the photosensitive silver halide emulsion in the upper layer or that of the photosensitive silver halide emulsion in the lower layer is higher than that of the inside fogged silver halide emulsion in the lower layer. In greater detail, it means that the sensitivity of the photosensitive silver halide emulsions is 10 or more times and, preferably, 100 or more times as high as that of the inside fogged silver halide emulsion.

The sensitivity used here has the same meaning as that defined in the following (in more detail, the sensitivity obtained by surface development (A) as defined hereinafter).

As the photosensitive silver halide emulsion, conventional silver halide emulsions such as surface latent image type silver halide emulsions, etc., are used.

The term "surface latent image type silver halide emulsion" means an emulsion in which the sensitivity obtained by surface development (A) is higher than that obtained by internal development (B) and, preferably, the sensitivity of the former is 2 or more times as high as that of the latter, in case of developing by the surface development (A) and the internal development (B) described hereinafter after being exposed to light for 1 to 1/100 second. The sensitivity used here is defined as follows.

$$S=(100/Eh)$$

wherein S represents a sensitivity and Eh represents an exposure necessary to obtain the density $\frac{1}{2}(D_{max}+D_{min})$ which is an average density of maximum density ($D_{max}$) and minimum density ($D_{min}$).

Surface Development (A)

Development is carried out in a developing solution having the following composition at 20° C. for 10 minutes.

N-Methyl-p-aminophenol (hemisulfate)—2.5 g
Ascorbic acid—10 g
Sodium metaborate (tetrahydrate)—35 g
Potassium bromide—1 g
Water to make—1 liter Internal Development (B)

The sensitive material is processed in a bleaching solution containing 3 g/l of potassium ferricyanide and 0.0126 g/l of phenosafranine at 20° C. for 10 minutes. After being washed with water for 10 minutes, development is carried out in a developing solution having the following composition at 20° C. for 10 minutes.

N-Methyl-p-aminophenol (hemisulfate)—2.5 g
Ascorbic acid—10 g
Sodium metaborate (tetrahydrate)—35 g
Potassium bromide—1 g
Sodium thiosulfate—3 g
Water to make—1 liter The surface latent image type silver halide used preferably contains silver iodide. For example, silver chloroiodide, silver iodobromide and silver chloroiodobromide can be used. In these cases, it is preferred that the silver iodide content is in a range of 0.1 to 30% by mol and, preferably, 0.5 to 10% by mol.

The photosensitive silver halide emulsions used in the upper layer and the lower layer (such as the surface latent image type silver halide emulsion) have an average particle size of being larger than that of the inside fogged silver halide emulsion used in the lower layer. The photosensitive silver halide emulsions used in the upper layer and the lower layer preferably have an average particle size of 0.2 μm to 10 μm, more preferably 0.5 μm to 3 μm, and particularly preferably 0.6 μm to 2 μm. The distribution of particle size of the photosensitive silver halide emulsions may be narrow or broad. Silver halide particles in the photosensitive silver halide emulsions may have a regular crystal form such as cube or octahedron. They may have an irregular crystal form such as sphere or plate, etc., or may have a composite form of these crystal forms. Further, they may be composed of a mixture of particles having various crystal forms.

With respect to kind of silver halide, the photosensitive silver halide emulsion in the upper layer and the photosensitive silver halide emulsion in the lower layer used in the present invention may be identical or different from each other. With respect to sensitivity, it is preferred that the sensitivity of the photosensitive silver halide emulsion in the lower layer is similar to or lower than that of the photosensitive silver halide emulsion in the upper layer. In greater detail, it is preferred that a ratio of sensitivity of the photosensitive silver halide emulsion in the upper layer to that of the photosensitive silver halide emulsion in the lower layer is 1:1.5 to 100:1, more preferably 1:1.5 to 10:1, and particularly preferably 1:1.5 to 5:1.

The photosensitive silver halide emulsions used in the upper layer and the lower layer of the present invention can be prepared by processes described in P. Glafkides, *Chimie et Physique Photographique* (published by Paul Montel Co., 1967), G. F. Duffin, *Photographic Emulsion Chemistry* (published by The Focal Press, 1966) and V. L. Zelikman et al., *Making and Coating Photographic Emulsion* (published by The Focal Press, 1964), etc. Namely, they may be prepared by a process such as an acid process, neutral process or ammonia process. Further, as a process for reacting soluble silver salts with soluble halogen salts, any of one-side mixing process, simultaneous mixing process or a combination of them may be used.

A process in which particles are formed under an excess amount of silver ions can also be used. A simultaneous mixing process in which the pAg of the liquid phase from which the silver halide is formed is kept at a constant value (the so-called controlled double jet process) can also be used.

According to this process, silver halide emulsions having a regular crystal form and a nearly uniform particle size can be obtained.

Two or more silver halide emulsions prepared respectively may be used as a mixture.

In the step of formation of silver halide particles or physical ageing, cadmium salts, zinc salts, lead salts, thallium salts, iridium salts or complex salts thereof, rhodium salts or complex salts thereof, or iron salts or complex salts thereof, etc., may be added.

The inside fogged silver halide emulsion used in the lower layer of the present invention (i.e., silver halide emulsion having fog nuclei in the inner part thereof) is an emulsion which yields (1) a transmission fog density of 0.5 or less (extending the density of the base itself) when a test sample prepared by applying the emulsion to a transparent base in a silver coating amount of 2 g/m$^2$ is developed with D-19 (developing solution designated by Eastman Kodak Co.) at 35° C. for 2 minutes without exposing to light and (2) a transmission fog density of 1.0 or more (excluding the density of the base itself) when the same test sample is developed with a developing solution prepared by adding 0.5 g/l of potassium iodide to D-19 at 35° C. for 2 minutes without exposing to light.

The silver halide emulsion having fog nuclei in the inner part can be prepared by various known processes. Useful fogging processes may involve processes which comprise applying light or X-rays; processes which comprise chemically producing fog nuclei with reducing agents, gold compounds or sulfur containing compounds; and processes which comprise producing the emulsion under a condition of low pAg and high pH, etc. In order to form the fog nuclei in only the inner part, both the inner part and the surface of the silver halide particles are fogged by the above-described process and, thereafter, fog nuclei on the surface are bleached with a solution of potassium ferricyanide. A more preferred process is that which comprises preparing a core emulsion having fog nuclei by a method of processing at a low pAg and a high pH or a method of chemically fogging, and covering the resulting core emulsion with a shell emulsion. This process for preparing the core-shell emulsion is known and described in U.S. Pat. No. 3,206,313.

An average particle size of the silver halide emulsion having fog nuclei in the inner part used in the lower layer is smaller than that of the photosensitive silver halide emulsion used in the upper layer and the lower layer (such as the surface latent image type silver halide emulsion). The silver halide emulsion having fog nuclei in the inner part preferably has an average particle size of 0.05 μm to 1.0 μm, more preferably 0.05 μm to 0.6 μm, and most preferably 0.05 μm to 0.5 μm.

Further, any of silver bromide, silver iodobromide, silver iodochlorobromide, silver chlorobromide and silver chloride may be used for the inside fogged silver halide emulsion.

A mixing ratio of the photosensitive silver halide emulsion to the inside fogged silver halide emulsion used in the lower layer of the silver halide photographic light-sensitive material of the present invention can be varied according to the type of emulsion, the kind of sensitive material to be used and contrast of emulsions to be used, etc., but it is preferred to be in a range of 100:1 to 1:100 and, preferably, 10:1 to 1:10.

Coating amount of the photosensitive silver halide in the upper layer is preferably about 0.1 to 10 g/m$^2$. Coating amount of the photosensitive silver halide in the lower layer is preferably about 0.1 to 10 g/m$^2$. Coating amount of the inside fogged silver halide is preferably about 0.1 to 10 g/m$^2$.

A ratio of the coated silver content of the silver halide emulsion in the upper layer (i.e., coating amount of the photosensitive silver halide in the upper layer) to that of the silver halide emulsion in the lower layer (i.e., total coating amount of the photosensitive silver halide and the inside fogged silver halide in the lower layer) varies according to the kind of emulsions to be used or the end use of the photographic material, etc., but it is preferred to be in a range of 1:5 to 10:1 and, preferably, 1:3 to 6:1. With respect to the optical density after development, the ratio of the optical density due to the upper layer to the optical density due to the lower layer is preferably in a range of 1:10 to 10:1 and more preferably 1:5 to 5:1.

The upper layer and the lower layer may be adjacent each other or may be separated by another layer.

The silver halide emulsion layer may have another layer containing a silver halide emulsion in addition to the above-described upper layer and lower layer.

Further, in the silver halide photographic light-sensitive materials, it is sufficient to have one silver halide emulsion layer having an upper layer and lower layer, but two or more silver halide emulsion layers (for example, three layers) may be present.

The protective layer of the silver halide photographic light-sensitive materials of the present invention is a layer composed of hydrophilic colloids such as those described hereinafter. Further, the protective layer may have a single layer structure or a multilayer structure.

The silver halide photographic light-sensitive materials of the present invention may be provided, if desired, with an antihalation layer, an intermediate layer, a filter layer or other layers.

Generally, soluble salts are removed from the silver halide emulsions used in the present invention after production thereof by precipitation or after physical ageing thereof. For this purpose, a known noodle water wash process in which gelatin is gelatinized may be used. Further, there is a precipitation process (flocculation) utilizing inorganic salts comprising polyvalent anions such as sodium sulfate, anionic surface active agents, anionic polymers (for example, polystyrenesulfonic acid), or gelatin derivatives (for example, aliphatic acyl gelatin, aromatic acyl gelatin and aromatic carbamoyl gelatin, etc.). The process for removing soluble salts may be omitted.

Although photosensitive silver halide emulsions which are not chemically sensitized (the so-called primitive emulsions) can be used, emulsions used are generally chemically sensitized. Chemical sensitization can be carried out by processes described in the above-described literatures written by Glafkides or Zelikman et al., or *Die Grundlagen der Photographischen Prozesse mit Silberhalogeniden,* edited by H. Frieser (Akademische Verlagsgesellshaft, 1968).

Namely, it is possible to use a sulfur sensitization process which comprises using a sulfur containing compound capable of reacting with silver ion or active gelatin; a reduction sensitization process which comprises using a reductive substrate; and a noble metal sensitization process which comprises using a compound of gold or other noble metals. These processes may be used alone or in combination. As sulfur sensitizers, it is possible to use thiosulfates, thioureas, thiazoles, rhodanines and other compounds, examples of which have been described in U.S. Pat. Nos. 1,574,944, 2,410,689, 2,278,947, 2,728,668, 3,656,955, 4,032,928 and 4,067,740. As reductive sensitizers, it is possible to use stannous salts, amines, hydrazine derivatives, formamidine sulfinic acid and silane compounds, etc., examples of which have been described in U.S. Pat. Nos. 2,487,850, 2,419,974, 2,518,698, 2,983,609, 2,983,610, 2,694,637, 3,930,867 and 4,054,458. In order to carry out noble metal sensitization, it is possible to use complex salts of metals of group VIII in the Periodic Table such as platinum, iridium or palladium, etc., in addition to gold complex salts. Examples of them have been described in U.S. Pat. Nos. 2,399,083, 2,448,060 and British Pat. No. 618,061, etc.

In the photographic light-sensitive materials of the present invention, various hydrophilic colloids can be used as a binder.

Useful colloids include hydrophilic colloids conventionally used in the photographic field, such as gelatin, colloidal albumin, polysaccharides, cellulose derivatives or synthetic resins, for example, polyvinyl compounds including polyvinyl alcohol derivatives and acrylamide polymers, etc. It is possible to use hydrophobic colloids, for example, dispersed polymerized vinyl compounds and, particularly, those which increase dimensional stability of photographic materials, together with the hydrophilic colloids. Suitable examples of these compounds include water-insoluble polymers produced by polymerization of vinyl monomers such as alkyl acrylate, alkyl methacrylate, acrylic acid, sulfoalkyl acrylate or sulfoalkyl methacrylate, etc.

Various compounds can be added to the above-described photographic emulsions in order to prevent deterioration of sensitivity or generation of fog during the production of sensitive material, during preservation or during processing. Examples of such compounds include heterocyclic compounds including 4-hydroxy-6-methyl-1,3,3*a*,7-tetraazaindene, 3-methylbenzothiazole and 1-phenyl-5-mercaptotetrazole, mercury containing compounds, mercapto compounds and metal salts.

Examples of other compounds which can be used include those described in K. Mees, *The Theory of the Photographic Process,* 3rd Edition (1966), U.S. Pat. Nos. 1,758,576, 2,110,178, 2,131,038, 2,173,628, 2,697,040, 2,304,962, 2,324,123, 2,394,198, 2,444,605 to 2,444,608, 2,566,245, 2,694,716, 2,697,099, 2,708,162, 2,728,663 to 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,662,339 and British Pat. Nos. 893,428, 403,789, 1,173,609 and 1,200,188, etc.

In the light-sensitive materials of the present invention, the photographic silver halide emulsion layer and other hydrophilic colloid layers can be hardened with suitable hardeners. Examples of the hardeners include vinylsulfonyl compounds as described in Japanese Patent Application (OPI) Nos. 76025/78, 76026/78 and 77619/78 (the term "OPI" as used herein refers to a "published unexamined Japanese patent application"); hardeners having active halogen; dioxane derivatives; and oxypolysaccharides such as oxystarch, etc.

Other additives, particularly, those useful for photographic emulsions, such as lubricants, sensitizers, light absorbing dyes or plasticizers, etc., can be added to the photographic silver halide emulsion layer.

Further, in the present invention, the silver halide emulsions may contain compounds which release iodine ion (for example, potassium iodide, etc.), and desired images can be obtained with using a developing solution containing iodine ion.

In light-sensitive materials of the present invention, the hydrophilic colloid layers may contain water-soluble dyes as filter dyes or for the purpose of antihalation or antiirradiation or other purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

In the light-sensitive materials of the present invention, the hydrophilic colloid layers may be mordanted with cationic polymers, etc., when they contain dyes or ultraviolet ray absorbing agents, etc. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362 and Japanese Patent Application (OPI) Nos. 47624/75 and 71332/75, etc.

The light-sensitive materials of the present invention may contain surface active agents for various purposes. Nonionic, ionic and ampholytic surface active agents can be used for each purpose. For example, there are polyoxyalkylene derivatives and ampholytic amino acids (including sulfobetaines). Such surface active agents have been described in U.S. Pat. Nos. 2,600,831, 2,271,622, 2,271,623, 2,275,727, 2,787,604, 2,816,920 and 2,739,891 and Belgian Pat. No. 652,862.

In the light-sensitive materials of the present invention, the photographic emulsions may be spectrally sensitized with sensitizing dyes so as to be sensitive to blue light of comparatively long wavelength, green light, red light or infrared light. Sensitizing dyes used include cyanine dyes, merocyanine dyes, complex cyanine dyes, complex merocyanine dyes, holopolar cyanine dyes, styryl dyes, hemicyanine dyes, oxonol dyes and hemioxonol dyes.

Useful sensitizing dyes used in the present invention have been described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent Application (OPI) No. 76525/73 and Belgian Pat. No. 691,807, etc.

In the present invention, the sensitizing dyes are used in the same amount as in conventional negative type silver halide emulsions. It is particularly advantageous to use them in such an amount that inherent sensitivity of the silver halide emulsion does not substantially deteriorate. They are preferably used in an amount of about $1.0\times10^{-5}$ to about $5\times10^{-4}$ mol of the sensitizing dyes per mol of silver halide and preferably about $4\times10^{-5}$ to $2\times10^{-4}$ mol of the sensitizing dyes per mol of silver halide.

In the photographic light-sensitive materials of the present invention, the photographic emulsion layer and the other layers are applied to a side or both sides of flexible bases conventionally used for photographic light-sensitive materials, such as plastic films, paper or cloth, etc., or rigid bases such as glass, porcelain or metal, etc. Useful examples of the elastic bases include films of semisynthetic or synthetic high polymers such as cellulose nitrate, cellulose acetate, cellulose acetate butyrate, polystyrene, polyvinyl chloride, polyethylene terephthalate or polycarbonate, etc., and coated or laminated papers having a baryta layer or an $\alpha$-olefin polymer layer (for example, polyethylene, polypropylene or ethylene/butene copolymer), etc. The bases may be colored with dyes or pigments. They may be blacked for the purpose of shielding light. The surface of these bases is generally subjected to undercoating treatment for improving adhesion to the photographic emulsion layer. The surface of the bases may be subjected to corona discharging, ultraviolet ray application or flame treatment, etc., before or after the undercoating treatment.

In the photographic light-sensitive materials of the present invention, the photographic emulsion layers and other hydrophilic colloid layers can be coated to the bases or other layers by various known coating methods. A dip coating method, a roll coating method, a curtain coating method and an extrusion coating method, etc., can be used for coating. Methods described in U.S. Pat. Nos. 2,681,294, 2,761,791 and 3,526,528 are advantageous methods.

Matting agents and/or smoothing agents may be added to the emulsion layer or, preferably, the protective layer in the silver halide photographic light-sensitive materials of the present invention. Examples of the matting agents include organic compounds such as water dispersive vinyl polymers such as polymethyl methacrylate, etc., and inorganic compounds such as silver halide, or strontium barium sulfate, etc., having a suitable particle size (those having a particle size of 0.3 to 5μ, or those having a particle size of 2 or more times and, particularly, 4 or more times of the thickness of the protective layer are preferred). Smoothing agents are useful for preventing problems caused by adhesion, likewise matting agents, and are effective for improving friction characteristics related to camera adaptability when photographing or projecting the movie film. Preferred examples include waxes such as liquid paraffin or higher aliphatic acid esters, etc., polyfluorohydrocarbons and derivatives thereof, and silicones such as polyalkyl polysiloxane, polyaryl polysiloxane, polyalkylaryl polysiloxane and alkylene oxide addition derivatives of them, etc.

The present invention can be utilized for any photographic light-sensitive material which requires high sensitivity or high contrast. For example, it can be utilized for X-ray photographic light-sensitive materials, lithographic photographic light-sensitive materials, black-and-white negative photographic light-sensitive materials, color negative photographic light-sensitive materials and color paper light-sensitive materials, etc.

Further, it can be utilized for diffusion transfer light-sensitive materials wherein undeveloped silver halide is dissolved and precipitated on an image receiving layer adjacent to the silver halide emulsion layer to form a positive image, and color diffusion transfer light-sensitive materials, etc.

In order to carry out photographic processing of the light-sensitive materials of the present invention, it is possible to use known processes and known processing solutions as described, for example, in *Research Disclosure,* No. 176, pages 28–30 (RD-17643). It is possible to use any photographic processing used for forming silver images (black-and-white photographic processing) or for forming dye images (color photographic processing). The processing temperature is generally chosen from a range of 18° C. to 50° C., but a temperature of lower than 18° C. or higher than 50° C. may be used.

For example, the developing solution used for carrying out black-and-white photographic processing can contain known developing agents. Useful developing agents include dihydroxybenzenes (for example, hydroquinone), 3-pyrazolidones (for example, 1-phenyl-3-pyrazolidone) and aminophenols (for example, N-methyl-p-aminophenol). These compounds can be used alone or in combination. The light-sensitive materials of the present invention can be processed with a developing solution containing imidazoles as a silver halide solvent described in Japanese Patent Application (OPI) No. 78535/82. Further, they can be processed with a developing solution containing a silver halide solvent and additives such as imidazole or triazole, described in Japanese Patent Application (OPI) No. 37643/83. The developing solutions generally contain other known preservatives, alkali agents, pH buffer agents and antifoggants, etc., and they may contain, if desired, solubilizing assistants, toning agents, development accelerators, surface active agents, defoaming agents, water softeners, hardeners and thickeners, etc.

To the photographic emulsions of the present invention, the so-called "litho type" development processing can be applied. "Litho type" development processing means development processing which is carried out infectiously under a low sulfurous ion concentration using dihydroxybenzenes as a developing agent for the purpose of photographic reproduction of linear images or photographic reproduction of halftone images using dots, as described in detail in Mason, *Photographic Processing Chemistry,* pages 163 to 165 (1966).

As a special type of development processing, a light-sensitive material containing a developing agent in, for example, an emulsion layer may be developed by processing in an aqueous solution of alkali. When the developing agent is hydrophobic, it can be added to the emulsion layer by various methods described in *Research Disclosure,* No. 169 (RD-16928), U.S. Pat. No. 2,739,890, British Pat. No. 813,253 and German Pat. No. 1,547,763, etc. Such development processing may be combined with silver salt stabilization processing using thiocyanate.

Conventional fixing solutions can be used. Useful fixing agents include thiosulfates and thiocyanates as well as known organic sulfur compounds which have an effect as a fixing agent. The fixing solutions may contain water-soluble aluminum salts as a hardener.

EXAMPLE 1

Preparation of Photosensitive Silver Halide Emulsions

A silver iodobromide emulsion (silver iodide content: 2% by mol) having an average particle size of 1.3μ was prepared from silver nitrate, potassium bromide and potassium iodide by a conventional ammonia process, and the resulting emulsion was chemically sensitized by a gold-sulfur sensitization process. 4-Hydroxy-6-methyl-1,3,3a,7-tetraazaindene was added in a suitable amount as a stabilizing agent to obtain a photosensitive silver iodobromide emulsion A. Then, a silver iodobromide emulsion (silver iodide content: 1.5% by mol) having an average particle size of 1.1μ which was different from the emulsion A was prepared by the same ammonia process and chemically sensitized by a gold-sulfur sensitization process. 4-Hydroxy-6-methyl-1,3,3a,7-tetraazaidene was added in a suitable amount as a stabilizing agent to obtain a photosensitive silver iodobromide emulsion B.

Preparation of Inside Fogged Emulsion (1)

An aqueous solution of silver nitrate and an aqueous solution of potassium bromide and sodium bromide mixed in a molar ratio of 7:3 were added simultaneously to a 2% aqueous solution of gelatin over 25 minutes with stirring at 55° C. The temperature was raised to 75° C., and suitable amounts of sodium hydroxide and silver nitrate were added thereto. Ageing was carried out for 15 minutes to form fog nuclei. The temperature was reduced to 55° C., and acetic acid and potassium bromide were added to reduce the pH and the pAg to their original values. Thereafter, an aqueous solution of silver nitrate and an aqueous solution of potassium bromide and sodium chloride mixed in a molar ratio of 7:3 were added simultaneously over 25 minutes. The product was washed by a conventional precipitation method, and dispersed again with a solution of gelatin to obtain an inside fogged silver chlorobromide emulsion C having an average particle size of 0.4μ.

Sample 1

On both sides of a polyester base which were subjected to undercoating, a lower emulsion layer composed of a mixture of the above-described photosensitive silver iodobromide emulsion A and the inside fogged silver chlorobromide emulsion C, an upper emulsion layer composed of only the emulsion A, and a protective layer composed of an aqueous solution of gelatin were formed by coating in turn. In this case, the silver content applied to both sides was 1.0 g/m$^2$ of the emulsion A and 1.0 g/m$^2$ of the emulsion C in the lower emulsion layer and 6.0 g/m$^2$ of the emulsion A in the upper emulsion layer.

Sample 2

On both sides of the same base as in Sample 1, a lower emulsion layer composed of a mixture of the above-described photosensitive silver iodobromide emulsion B and the inside fogged silver chlorobromide emulsion C, an upper emulsion layer composed of only the emulsion A, and a protective layer composed of an aqueous solution of gelatin were formed by coating in turn. In this case, the silver content applied to both sides was 1.0 g/m$^2$ of the emulsion B and 1.0 g/m$^2$ of the emulsion C in the lower emulsion layer and 6.0 g/m$^2$ of the emulsion A in the upper emulsion layer.

Comparison Sample 1

On both sides of the same base as in Sample 1, an emulsion layer composed of a mixture of the photosensitive silver iodobromide emulsion A and the inside fogged silver chlorobromide emulsion C, and a protective layer composed of the aqueous solution of gelatin were formed by coating in turn. The silver content coated to both sides was 7.0 g/m$^2$ of the emulsion A and 1.0 g/m$^2$ of the emulsion C.

Comparison Sample 2

On both sides of the same base as in Sample 1, a lower emulsion layer composed of only the above-described inside fogged silver chlorobromide emulsion C, an upper emulsion layer composed of only the above-described photosensitive silver iodobromide emulsion A, and a protective layer composed of an aqueous solution of gelatin were formed by coating in turn. The silver content coated to both sides was 1.0 g/m$^2$ of the emulsion C in the lower emulsion layer and 7.0 g/m$^2$ of the emulsion A in the upper emulsion layer.

After the resulting samples were exposed to light through an optical wedge, they were processed with a developing solution A having the following composition at 20° C. for 4 minutes, and they were then fixed, washed with water and dried.

| Developing Solution A: | |
|---|---|
| 1-Phenyl-3-pyrazolidone | 0.5 g |
| Hydroquinone | 20.0 g |
| Disodium ethylenediaminetetraacetate | 2.0 g |
| Potassium sulfite | 60.0 g |
| Boric acid | 4.0 g |
| Potassium carbonate | 20.0 g |
| Sodium bromide | 5.0 g |
| Diethylene glycol | 30.0 g |
| Water to make | 1 liter |
| NaOH to make pH 10.0 | |

Sensitometry of the resulting images were carried out. Results are shown in Table 1.

TABLE 1

| Sample | Relative Sensitivity | Fog (including density of base) | Maximum Density | γ |
|---|---|---|---|---|
| Sample 1 | 100 | 0.13 | 3.5 | 2.6 |
| Sample 2 | 100 | 0.14 | 3.5 | 2.6 |
| Comparison Sample 1 | 100 | 0.13 | 3.5 | 2.7 |
| Comparison Sample 2 | 95 | 0.15 | 3.1 | 2.4 |

It is understood from the results shown in Table 1 that the effect described in Japanese Patent Publication No. 2068/66 (corresponding to U.S. Pat. No. 2,996,382) is obtained in Samples 1 and 2 having layer construction of the present invention similar to the blend type Comparison Sample 1. When two kinds of emulsions are coated as different layers as in Comparison Sample 2, photographic properties thereof are inferior to those of Comparison Sample 1.

Figure 2:
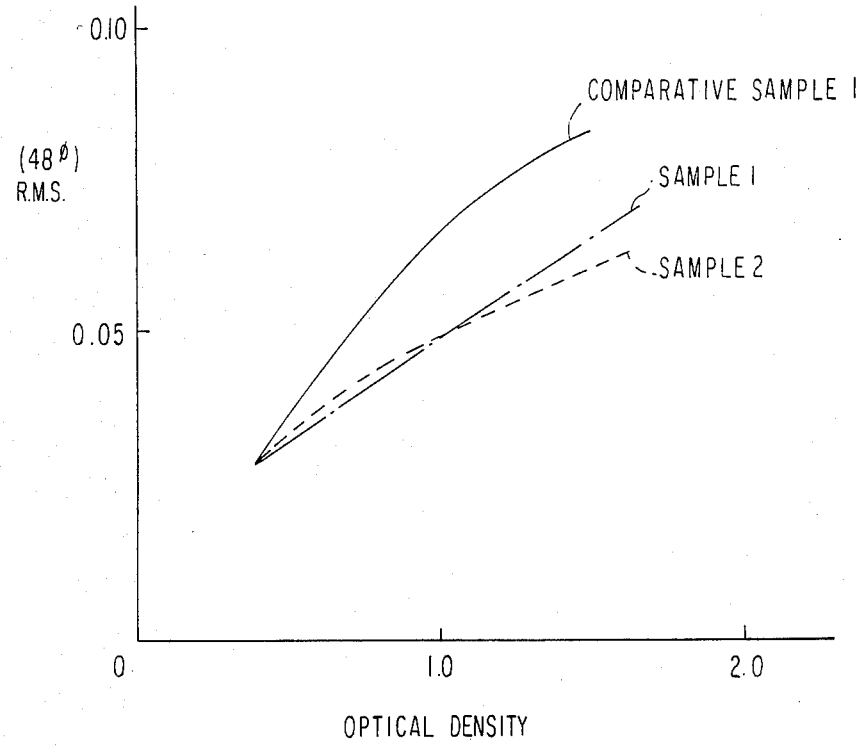
FIG. 2 is a graph which shows values of R.M.S. granularity to optical densities of Sample 1 and Sample 2 of the present invention and Comparative Sample 1.

In order to compare the granularities of Samples 1 and 2 and Comparison Sample 1, they were subjected to the above-described processing after being exposed to X-rays using a sensitizing paper (high screen standard produced by Fuji Photo Film Co., Ltd.), and measurement of R.M.S. granularity was carried out. Results are shown in FIG. 2.

In the drawing, values of R.M.S. granularity of Samples 1 and 2 are reduced over a wide range of optical density as compared to Comparison Sample 1. Accordingly, it is understood that the granularities of Samples 1 and 2 are remarkably excellent.

The above-described results mean that the layer construction of the present invention can provide good photographic properties and remarkably improved granularity as compared with those obtained by using the technique described in Japanese Patent Publication No. 2068/66 (corresponding to U.S. Pat. No. 2,996,382).

EXAMPLE 2

Preparation of Inside Fogged Emulsion (2)

The same process as that for preparing the inside fogged emulsion described in Example 1 was carried out to obtain an inside fogged silver chlorobromide emulsion D having an average particle size of 0.2μ which was different from the emulsion C.

SAMPLE 3

The same sample as Sample 1 was prepared using the above-described inside fogged silver chlorobromide emulsion D instead of the inside fogged silver chlorobromide emulsion C. In this case, the silver content coated on both sides was 1.0 g/m$^2$ of the emulsion A and 1.0 g/m$^2$ of the emulsion D in the lower emulsion layer and 6.0 g/m$^2$ of the emulsion A in the upper emulsion layer.

Comparison Sample 3

The same sample as Comparison Sample 1 was prepared using the above-described inside fogged silver chlorobromide emulsion D instead of the inside fogged silver chlorobromide emulsion C. In this case, the silver content coated on both sides was 7.0 g/m$^2$ of the emulsion A and 1.0 g/m$^2$ of the emulsion D.

The same experiments of these samples were carried out as in Example 1, and similar results were obtained.

As a result of visual judgment of the color tone of the resulting images, the tone in Sample 3 was pure black, while the tone in Comparison Sample 3 was brownish.

The above-described fact shows that when inside fogged fine silver halide particles having 0.2μ are used the resulting developed silver image becomes brownish. But, the layer construction of the present invention can improve the tone of the resulting developed silver image even though the inside fogged fine silver halide particles having 0.2μ are used.

EXAMPLE 3

A number of test samples of Samples 1, 2 and 3 and Comparison Samples 1 and 3 were processed with the following developing solution B in the following steps by means of an RN automatic developing apparatus produced by Fuji Photo Film Co., Ltd.

| Processing Steps: | | |
|---|---|---|
| Development | 35° C. | 25 seconds |
| Fixation | 32° C. | 25 seconds |
| Water wash | 32° C. | 25 seconds |
| Drying | 50° C. | 15 seconds |

| Developing Solution B: | |
|---|---|
| Potassium hydroxide | 29.14 g |
| Glacial acetic acid | 10.96 g |
| Potassium sulfite | 44.20 g |
| Sodium bicarbonate | 7.50 g |
| Boric acid | 1.00 g |
| Diethylene glycol | 28.96 g |
| Ethylenediaminetetraacetic acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium metabisulfite | 12.60 g |
| Water to make | 1 liter |

Irregular stains were observed in the resulting images. The degree of stain and probability of occurrence of stain were examined. Results are shown in Table 2.

TABLE 2

| Sample | Degree of Stain | Probability of Occurrence of Stain |
|---|---|---|
| Sample 1 | Partial occurrence of quite thin stains | 0.25 |
| Sample 2 | Partial occurrence of quite thin stains | 0.25 |
| Sample 3 | Partial occurrence of quite thin stains | 0.30 |
| Comparison Sample 1 | Occurrence of thick stains in a wide range | 1 |
| Comparison Sample 3 | Occurrence of thick stains in a wide range | 1 |

It is understood from the results shown in Table 2 that there is a reduced degree of stain with the samples of the present invention as compared with the comparative samples. These results mean that irregular stains caused by directly passing through the fixing bath from the development bath by means of an automatic developing apparatus without passing through the stopping bath can be improved by providing the layer construction of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support base having positioned thereon:

a silver halide emulsion layer; and a protective layer;

the silver halide emulsion layer being comprised of an upper layer and lower layer, the upper layer comprising a photosensitive silver halide emulsion, the lower layer comprising a photosensitive silver halide emulsion and an inside fogged silver halide emulsion, and the particle size of the inside fogged silver halide is smaller than that of the particle size of the photosensitive silver halide in the upper layer and the lower layer wherein the photosensitive silver halide emulsion in the upper layer and the lower layer contains silver iodide in an amount within the range of 0.1 to 30% by mol.

2. A silver halide photographic light-sensitive material as claimed in claim 1, wherein the sensitivity of the photosensitive silver halide emulsion in the upper layer and the lower layer is 10 or more times greater than the sensitivity of the inside fogged silver halide emulsion in the lower layer.

3. A silver halide photographic light-sensitive material as claimed in claim 2, wherein the sensitivity of the photosensitive halide emulsion in the upper layer and the lower layer is 100 or more times greater than the sensitivity of the inside fogged silver halide emulsion in the lower layer.

4. A silver halide photographic light-sensitive material as claimed in claim 1, wherein the photosensitive silver halide emulsion in the upper layer and the lower layer contains silver iodide in an amount of 0.5 to 10% by mol.

5. A silver halide photographic light-sensitive material as claimed in claim 1, wherein the average particle size of the photosensitive silver halide emulsion in the upper layer and the lower layer is 0.2 μm to 10 μm.

6. A silver halide photographic light-sensitive material as claimed in claim 1, wherein the average particle size of the inside fogged silver halide emulsion in the lower layer is 0.05 μm to 1.0 μm.

7. A silver halide photographic light-sensitive material as claimed in claim 1, wherein the photosensitive silver halide emulsion in the upper layer and the lower layer is a surface latent image type silver halide emulsion.

* * * * *